United States Patent [19]

Lombardi

[11] Patent Number: 4,899,633

[45] Date of Patent: Feb. 13, 1990

[54] DRUM SYNTHESIZER TRIGGERING APPARATUS

[76] Inventor: Donald G. Lombardi, 2118 E. Hillcrest Dr., Thousand Oaks, Calif. 91360

[21] Appl. No.: 189,108

[22] Filed: May 2, 1988

[51] Int. Cl.[4] ..... G10H 3/14

[52] U.S. Cl. ..... 84/730; 84/DIG. 12; 84/DIG. 24

[58] Field of Search ..... 84/1.04, 1.06, 1.11–1.15, 84/DIG. 12, DIG. 24

[56] References Cited

U.S. PATENT DOCUMENTS 4,226,156 10/1980 Hyakutake ..... 84/1.14

*Primary Examiner*—Stanley J. Witkowski

*Attorney, Agent, or Firm*—William W. Haefliger

[57] ABSTRACT

A triggering apparatus for triggering an acoustic drum synthesizer includes (a) a body attachable to the frame of an acoustic drum to transmit acoustic vibrations from the drum frame or shell, the body configured to pass a drum receiver rod, (b) dual transducer structures carried by the body to be responsive to the transmitted vibrations, to produce signals, (c) and circuitry connected to the dual transducer structures to process the signals, passing only a selected high frequency band of such signals to the synthesizer, to trigger same.

12 Claims, 2 Drawing Sheets

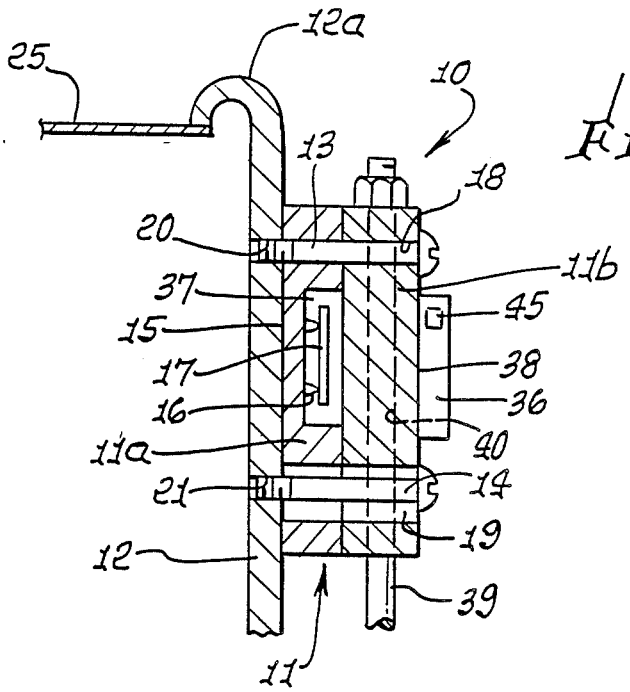
FIG. 1.
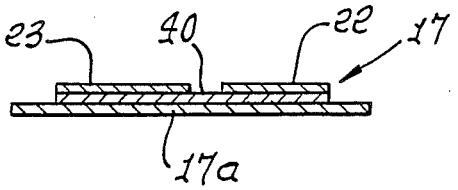
FIG. 3.
FIG. 2.
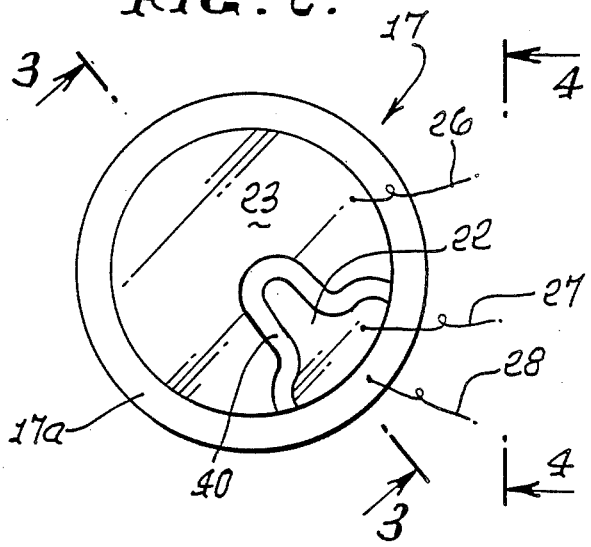
FIG. 4.
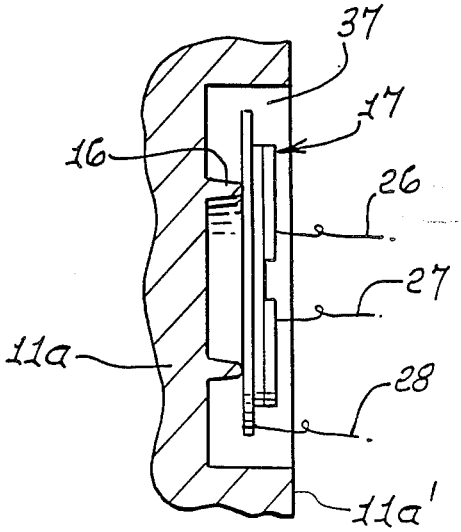

DRUM SYNTHESIZER TRIGGERING APPARATUS

INTRODUCTION AND BRIEF DESCRIPTION

This invention concerns an electro-mechanical assembly to convert drum beats to electrical signals capable of triggering a drum synthesizer. The assembly includes a piezoelectric, self-driven acoustic transducer and a battery powered electonic circuit mounted in an enclosure especially designed to optimize the conversion of drum vibration to electric signals. The enclosure also has a built-in lug receiver to accept drum rim fastening hardware so that it replaces one of the lug receivers on a drum. The assembly mounts on the drum via existing holes used to fasten the lug receiver it replaces. These design features result in a large improvement in electrical performance and mechanical reliability, without modification of the drum shell.

BACKGROUND OF THE INVENTION

There are two main shortcomings to the current techniques for using an acoustic drum to activate the sound programs of synthetic drum machines: tracking sensitivity and mechanical reliability. Drum synthesizers are designed to be triggered by a device called a "pad." Pads are very different from acoustic drums in that they are highly damped, solid devices containing a transducer capable of detecting the force of impact of a drum stick. Because of its highly damped nature, the duration of a pad's output signal is very short, i.e. on the order of 4–8 milliseconds. Since a pad is solid, with no resonating chamber, it is incapable of producing any appreciable acoustic sound by itself. A drum synthesizer is designed for a 4–8 millisecond trigger input to activate its sound output.

In order to produce an electronic trigger signal from an acoustic drum, a transducer has been attached to the drum to detect the force of impact of a drum stick on the drum head. However, because of the drum's tendency to resonate after the initial impact the trigger output is significantly longer than 4–8 milliseconds. Also a drum is not designed to have transducers attached to it, and the current methods of attaching the transducer are often mechanically unreliable.

There are three basic methods of mounting transducers on an acoustic drum: air coupling including internal mounting, head mounting and shell mounting.

Air coupling consists of a transducer such as a microphone that is suspended inside or outside of the drum shell in close proximity to the drum head. This method picks up the vibrating air caused by the movement of the drum head. Internal mounting of a microphone often involves extensive modification of the acoustic drum and constant monitoring to ensure mechanical reliability. The duration of the signal produced is very long, and the microphone cannot discriminate between drum sound and background noise.

Head mounting usually involves gluing or taping a transducer to the drum head. The main disadvantage of this technique is the damping of the natural drum sound, adversely affecting the acoustic characteristics of the drum sound. Also, the adhesive used typically cannot withstand the constant vibration of the drum head, and the transducer eventually falls off.

In shell mounting, a transducer is glued or screwed to the drum shell, and the transducer can be either inside or outside of the drum. Shell mounting is mechanically more reliable, and results in the shortest signal duration of the three mounting methods. It is, however, not as sensitive to head movement as it is to shell movement. The shell will vibrate with the drum head, and the signal from the shell transducer will have charcteristics that are undesirable for triggering purposes. The transducer used in head and shell mounting is almost always small a piezoelectric wafer or bar less than an inch in length or diameter. The transducer is often enclosed in a small light weight plastic or metal housing which may have holes for mounting screws.

All three transducer mounting methods have similar disadvantages: dangling wires, unreliable mounting schemes and a relatively long signal duration, typically 100–400 milliseconds. The long signal duration often results in unwanted re-triggering. The most common method of overcoming this problem is to set the sensitivity threshold of the drum synthesizer to an area where the tail end of the transducer signal cannot cause re-triggering of the drum synthesizer. However, reducing the sensitivity threshold results in substantially limiting the range of force of impact of a drum stick that will trigger the drum synthesizer. For example, a drummer may be forced to play in the medium soft to medium loud range. To maximize the range of force that the drum synthesizer will track, an alternate method of reducing the signal duration is to dampen the drum head. The disadvantage here is the adverse effect on the sound quality of the acoustic drum.

SUMMARY OF THE INVENTION

It is a major object of the invention to provide highly advantageous triggering means for triggering an acoustic synthesizer, and characterized as overcoming the above difficulties and problems. Basically, the invention is embodied in a combination that includes:

(a) a body having attachment means thereon for firmly attaching the body to the frame of an acoustic drum so as to transmit acoustic vibrations from the shell, the body configured to pass a drum receiver rod, (b) dual transducer means carried by the body to be responsive to the transmitted vibration to produce corresponding signals, (c) a circuit means connected to the dual transducer means to process said signals, passing only a selected high frequency band of such signals to the synthesizer to trigger same.

As will be seen the body typically contains a recess in which said dual tranducer means is mounted and attached to the body. Also, the dual transducer means typically includes two piezo elements extending as thin sheets to be subjected to flexing in response to said vibration transmission. Such piezo elements may comprise crystalline material forming said thin sheets which are separated and carried on a flexible substrate.

It is a further object of the invention to provide two output leads respectively connected to the two crystalline sheets, and a third lead connected to the substrate, there being a differential amplifier connected to said two piezo sheets via the respective two output leads, the amplifier having an output side. The drum synthesizer then has an input side coupled to said output side of the differential amplifier.

A further object is to provide the mounting body with two openings for passing fasteners that attach the body to the drum frame, one of said openings being elongated and in alignment with the other of the openings, whereby fasteners of different spacings may be received and passed by said openings. A drum receiver rod or lug is carried by the frame and passed through a further opening the body or block.

THEORY OF OPERATION OF THE INVENTION

A drum stick striking the surface of a drum head has a higher frequency content than the natural overtone series of a vibrating drum. Analysis of the frequency components of an acoustic drum shows that most of the resonance of a drum is of a lower frequency than the initial shock of impact. Moreover, the duration of the initial impact is short. By limiting the output of the transducer to these higher frequencies caused by the impact of a drum stick, a signal duration of 4–20 milliseconds is obtained. This is adequate for drum synthesizer triggering. This frequency limiting or tuning is obtained both mechanically and electronically.

MOUNTING THE TRANSDUCER ON A MASSIVE BLOCK

By mounting the transducer on a fairly stiff substance such as a metallic, high density plastic or ceramic block or bar, high frequency vibrations are more readily transmitted to the transducer than low frequencies. This block or bar is sufficiently massive to dampen any low frequency vibration present in the shell in the immediate vicinity of the transducer. By mounting a piezoelectric disc on a raised metal ring of a diameter corresponding to the vibrational node of the disc (node support mounting), a signal is produced of higher frequency and higher amplitude than is obtained from other mounting techniques.

Electrical methods of frequency discrimination include an R-C high pass filter and the use of a three wire piezoelectric device connected to a differential amplifier. With high pass filtering, the low frequency signal components are attenuated. A three wire piezoelectric device is an efficient way of eliminating lower frequency components. Consider two piezoelectric devices in close proximity. Vibrations that are common to both sensors will then produce identical electrical signals from each sensor. If the electrical signals are combined differentially, as in a differential amplifier, they will cancel. Signals which are different will be amplified. The vibrations which are not common between the two transducers are higher in frequency with wavelengths that are a function of the distance between the sensors. For extremely high frequency (greater than 20 KHz) a small self-driven piezoelecric acoustic element with two metal ink contact areas on a common substrate (a three wire piezoelectric device) is connected to a differential amplifier. The output wavelength is therefore equal to the distance between metal ink areas of the transducer. These higher frequency components are only produced by the initial force of impact and not by the resonant ringing of the drum. The differential amplifier optimizes high frequency characteristics and provides an output characteristic that works well with a drum synthesizer.

COMBINING THE SENSOR WITH A LUG RECEIVER

The acoustic drum typically has lug receivers mounted around the circumference of the shell that are used to apply tension to the drum head via lugs. A lug is a threaded rod which screws into the receiver. Lug receivers are attached to the drum through small holes in the shell via bolts. By taking advantage of the bolt holes, the transducer block of the invention is mounted on the drum without requiring drilling of extra holes in the shell, or use of adhesives. By including a threaded receiver in the sensor mounting fixture, the device is able to replace the receiver lug. The device also has a means to connect the sensor's electrical signals to the drum synthesizer. The connector is an integral part of the mounting fixture so is extremely reliable. A battery is typically housed in the block to directly provide power to the amplifier.

COMPONENTS

These and other objects and advantages of the invention, as well as the details of an illustrative embodiment, will be more fully understood from the following specification and drawings, in which:

DRAWING DESCRIPTION

FIG. 1 is a section in elevation taken through a device embodying the invention, attached to a drum shell;

FIG. 2 is an enlarged plan view showing one side of a dual transducer assembly used in the FIG. device;

FIG. 3 is a section on lines 3—3 of FIG. 2;

FIG. 4 is an edge view taken on lines 4—4 of FIG. 2;

DETAILED DESCRIPTION

Figure 5:
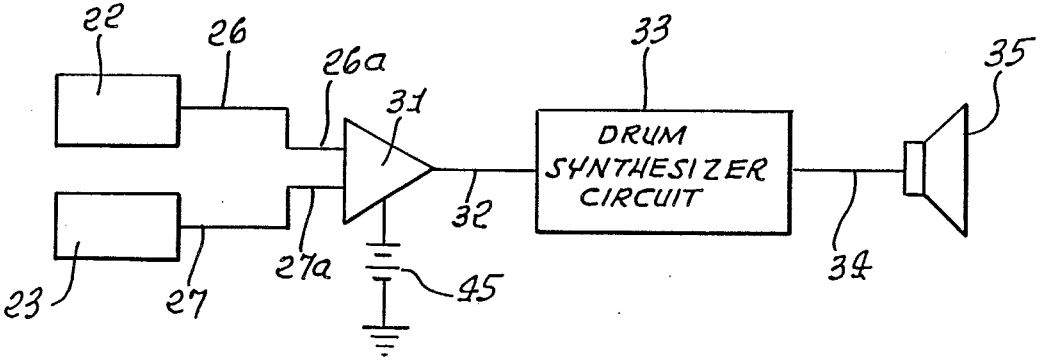
FIG. 5 is a circuit block diagram.

In FIG. 1, a composite unit 10 includes a body 11 including sections or block 11*a* and 11*b* firmly attached to the cylindrical outer frame 12 of a bass drum, as by attachment means comprising two fasteners 13 and 14. The attachment is such that acoustic vibrations are directly transmitted from the shell to the body section 11*a* i.e. at interface 15 therebetween. Such vibrations are also transmitted from the body section 11*a* to an annular ring 16 integral with the section 11*a*, and then to the dual transducer means or unit 17 attached to ring 16, as by adhesive. The ring and transducer unit are located within a recess 37 sunk in the outer side 11*a'* of the section 11*a*, and as better seen in FIG. 4.

The body 11 has two openings 18 and 19 for passing the two clamping fasteners 13 and 14, opening 18 being sized slightly larger than the shank of fastener 13, and opening 19 being elongated in a direction in lateral alignment with opening 18. Accordingly fasteners of different lateral spacings may be received in and passed by the openings, with the body 11 correspondingly adjusted. This compenstates for different lateral spacings of the threaded openings 20 and 21 in the shell, as may occur for different drum shells. Thus, the unit 10 is attachable to different drum shells after removal of a lug receiver that normally attaches to the shells, as via fasteners extending into threaded openings 20 and 21.

The dual transducer unit 17 is better seen in FIGS. 2–4 as including two contact elements 22 and 23 (separated by a uniform width gap) extending in the form of thin sheets (as for example of conductive metal such as silver) to be subjected to flexing in response to vibration transmission to the frame, body, and ring 16, as described above, when the drum head 25 is struck by a drum stick, or when the frame 12 is so struck (as at 12*a*). The two elements 22 and 23 are separated, and carried on (i.e. bonded to) a piezoelectric disc 40, the underside of which is bonded to a flexible, conductive substrate 17*a*, for example a thin sheet of copper, bonded to ring 16. The piezoelectric disc 40 may consist of barium titanate. Wires or leads 26–28 are connected with the thin conductive contacts 22 and 23, and with substrate 17*a*, as shown, and outputs appear on leads 26 and 27, (lead 28 may be considered as a ground lead). One such transducer is produced by Murata Inc.

Figure 6:
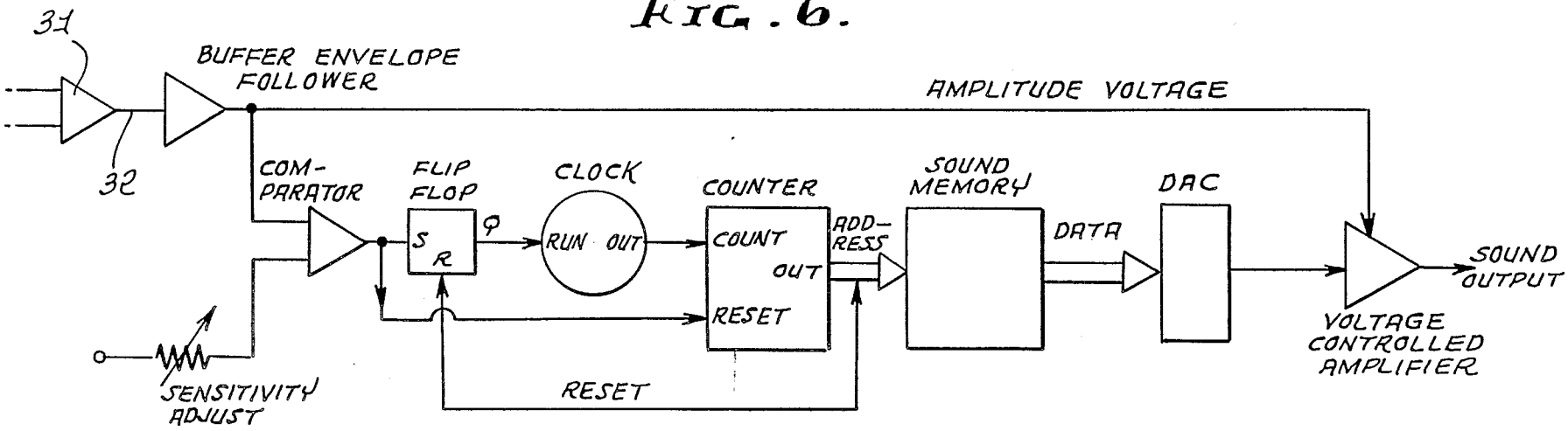
FIG. 6 is a circuit block diagram.

FIG. 5 shows the two outputs at 26*a* and 27*a* passed to the input terminals of a differential amplifier 31, and the output 32 of the latter is passed to the drum synthesizer circuit 33. FIG. 6 shows a typical drum synthesizer circuit, its output at 34 passed to a speaker or speakers 35.

The above combination operates as set forth in the introduction, and has the unusual advantages, as described, including limiting the transducer's outputs to a signal duration of 4–20 milliseconds. Only a selected band of high frequency signals is then transmitted to the synthesizer, to trigger same. Note, again, in FIG. 1, that the circuitry at 31 may be incorporated in a solid state unit seen at 36, in FIG. 1, as attached to body section 11*b*, as at interface 38. Therefore, the entire combination, except for the synthesizer circuit 33 may be incorporated in a single unit or part 10, easily attached to the drum frame, as described. Snare, tom tom, or bass drums are usable.

Part 10 also contains a longitudinally extending opening 40 for passing a "lug" or rod 39. A series of such lugs, spaced about the drum are tensioned for supporting the drum frame. Opening 40 passes through section 11*b* of the body, outwardly of the dual transducer.

A DC battery source to power the amplifier 31 is indicated at 45.

The drum synthesizer circuit of FIG. 6 is a known circuit, examples of which are produced and sold by Dynacord Corp., Simions Corp., and Lynn Drum Corp.

I claim:

1. In a triggering means for triggering an acoustic drum synthesizer, the combination comprising:

(a) a body having attachment means thereon for firmly attaching the body to the frame of an acoustic drum so as to transmit acoustic vibrations from the frame, the body configured to pass a drum receiver rod, (b) dual transducer means carried by the body to be responsive to the transmitted vibrations to produce corresponding signals, (c) and circuit means connected to the dual transducer means to process said signals, passing only a selected high frequency band of such signals to the synthesizer to trigger same, (d) and including said acoustic drum frame to which said body is attached, externally of the frame, and a drum tensioner rod carrier by the frame and passing through the body, (e) the body comprising a block of material within which said dual transducer means is concealed and contained, and means clamping the body against the frame, to receive acoustic vibrations therefrom, and to pass said tensioner rod, there being support means integral with the body, the dual transducer means carried in position to receive transmission of acoustic vibrations from the block, via said support means.

2. The combination of claim 1 wherein said body contains a recess in which said dual transducer means is mounted and attached to the body.

3. The combination of claim 1 wherein said dual transducer means includes two piezo elements extending as thin sheets to be subjected to flexing in response to said vibration transmission.

4. The combination of claim 3 wherein said piezo elements comprise crystalline material forming said thin sheets which are separated and carried on a flexible substrate.

5. The combination of claim 4 wherein said crystalline material consists of barium titanate.

6. The combination of claim 4 including two output leads respectively connected to the two crystalline sheets, there being a differential amplifier connected to said piezo sheets via the respective two inputs leads, the amplifier having an output side.

7. The combination of claim 6 including said drum synthesizer having an input side coupled to said output side of the differential amplifier.

8. The combination of claim 1 wherein said drum comprises a snare drum.

9. The combination of claim 1 wherein said body has two openings for passing said clamping means in the form of fasteners that attach the body to the drum frame, one of said openings being elongated and in alignment with the other of the openings, whereby fasteners of different spacings may be received and passed by said openings.

10. The combination of claim 9 wherein said circuit means is carried by said block.

11. The combination of claim 10 wherein said dual transducer means includes two piezo elements extending as thin sheets to be subjected to flexing in response to said vibration transmission.

12. The combination of claim 11 including a DC battery power source carried by the block.

* * * * *